US012686911B2

(12) United States Patent
Harrington et al.

(10) Patent No.: US 12,686,911 B2
(45) Date of Patent: Jul. 21, 2026

(54) CHEMICALLY COMPLEX CERAMIC ABRADABLE SEALANT MATERIALS

(71) Applicant: Oerlikon Metco (US) Inc., Westbury, NY (US)

(72) Inventors: Tyler Harrington, New York, NY (US); Hwasoo Lee, Hicksville, NY (US); Timothy Tadros Sharobem, Brooklyn, NY (US); Gregory Szyndelman, Villigen (CH)

(73) Assignee: OERLIKON METCO (US) INC., Westbury, NY (US)

( * ) Notice: Subject to any disclaimer, the term of this patent is extended or adjusted under 35 U.S.C. 154(b) by 21 days.

(21) Appl. No.: 18/550,517

(22) PCT Filed: Mar. 16, 2022

(86) PCT No.: PCT/US2022/020587
§ 371 (c)(1),
(2) Date: Sep. 14, 2023

(87) PCT Pub. No.: WO2022/197827
PCT Pub. Date: Sep. 22, 2022

(65) Prior Publication Data

US 2024/0158902 A1 May 16, 2024

Related U.S. Application Data

(60) Provisional application No. 63/162,228, filed on Mar. 17, 2021.

(51) Int. Cl.
*C23C 4/11* (2016.01)

(52) U.S. Cl.
CPC ..... *C23C 4/11* (2016.01)

(58) Field of Classification Search
None
See application file for complete search history.

(56) References Cited

U.S. PATENT DOCUMENTS

| | | | | |
|---|---|---|---|---|
| 4,421,799 | A | 12/1983 | Novinski | |
| 4,578,114 | A | 3/1986 | Rangaswamy et al. | |
| 5,059,095 | A | 10/1991 | Kushner et al. | |
| 5,939,146 | A * | 8/1999 | Lavernia | C23C 4/126 29/DIG. 39 |
| 5,997,248 | A | 12/1999 | Ghasripoor et al. | |
| 6,812,176 | B1 | 11/2004 | Zhu et al. | |
| 6,887,528 | B2 | 5/2005 | Lau et al. | |
| 7,001,859 | B2 | 2/2006 | Zhu et al. | |
| 7,186,466 | B2 | 3/2007 | Zhu et al. | |
| 8,187,717 | B1 | 5/2012 | Xie et al. | |
| 9,581,041 | B2 | 2/2017 | Sinatra et al. | |
| 9,975,812 | B2 | 5/2018 | Doesburg et al. | |
| 2005/0196271 | A1 | 9/2005 | Wilson et al. | |
| 2008/0107920 | A1 * | 5/2008 | Rowe | C23C 28/345 428/701 |
| 2009/0060747 | A1 | 3/2009 | Strock et al. | |
| 2011/0164963 | A1 | 7/2011 | Taylor | |
| 2015/0167141 | A1 | 6/2015 | Rosenzweig et al. | |
| 2016/0251975 | A1 | 9/2016 | Strock et al. | |
| 2016/0347671 | A1 | 12/2016 | Strock | |
| 2017/0122560 | A1 * | 5/2017 | Nagaraj | F23R 3/286 |
| 2018/0022928 | A1 | 1/2018 | Blush | |
| 2018/0022929 | A1 | 1/2018 | Blush | |
| 2018/0128952 | A1 | 5/2018 | Yeh | |
| 2018/0298776 | A1 | 10/2018 | Strock et al. | |
| 2019/0203603 | A1 * | 7/2019 | Jorgensen | C04B 35/62222 |
| 2019/0271235 | A1 * | 9/2019 | Hass | C23C 14/02 |
| 2019/0284673 | A1 * | 9/2019 | Landwehr | C23C 28/347 |
| 2020/0003125 | A1 | 1/2020 | Amini et al. | |
| 2020/0024974 | A1 | 1/2020 | Jackson | |
| 2020/0141260 | A1 | 5/2020 | Seymour et al. | |

FOREIGN PATENT DOCUMENTS

| | | | |
|---|---|---|---|
| AU | 2014221259 | A1 | 10/2014 |
| CA | 2431310 | A1 | 6/2002 |
| CA | 2488949 | A1 | 6/2005 |
| CA | 2549600 | A1 | 12/2006 |
| CA | 2585992 | A1 | 12/2007 |
| CA | 2686332 | A1 | 5/2010 |
| CA | 2880147 | A1 | 2/2014 |
| CA | 2914289 | A1 | 6/2016 |
| CA | 3051995 | A1 | 2/2020 |
| EP | 0455996 | A1 | 11/1991 |

(Continued)

OTHER PUBLICATIONS

Anand, G., et al., "Phase stability and distortion in high entropy oxides", Acta Materialia 146 (2018) pp. 119-125; https://doi.org/10.1016/j.actamat.2017.12.037.

Berardan, D., et al., "Room temperature Lithium superionic conductivity in high entropy oxides", Journal of Materials Chemistry A, (2016), 4, pp. 9536-9541; DOI: 10.1039/c6ta03249d.

Berardan, D., et al., "Colossal dielectric constant in high entropy oxides", Phys. Status Solidi RRL 10, No. 4, (2016), pp. 328-333; DOI: 10.1002/pssr.201600043.

Berardan, D., et al., "Controlled Jahn-Teller distortion in (MgCoNiCuZn)O-based high entropy oxides", Journal of Alloys and Compounds, 704 (2017) pp. 693-700; http://dx.doi.org/10.1016/j.jallcom.2017.02.070.

(Continued)

*Primary Examiner* — Shamim Ahmed
*Assistant Examiner* — Bradford M Gates
(74) *Attorney, Agent, or Firm* — Chrisman Gallo Tochtrop LLC

(57) ABSTRACT

A chemically complex oxide powder is provided that forms an abradable sealant coating for a turbine engine. Primary property advantages of the chemically complex oxide include low resistance to erosion and reduced wear on blades and labyrinth seal knife edges in a turbine engine. Secondary property advantages include improved thermal properties, excellent sintering resistance, excellent phase stability, and high resistance to chemical attack.

29 Claims, No Drawings

(56) References Cited

FOREIGN PATENT DOCUMENTS

| | | | |
|---|---|---|---|
| EP | 1371815 | A1 | 12/2003 |
| EP | 1500790 | A2 | 1/2005 |
| EP | 1548144 | A1 | 6/2005 |
| EP | 3141704 | A1 | 3/2017 |
| EP | 3369487 | A1 | 9/2018 |
| EP | 2683844 | B1 | 5/2019 |
| EP | 3597860 | A1 | 1/2020 |
| EP | 3597871 | A1 | 1/2020 |
| EP | 3623355 | A1 | 3/2020 |
| ES | 2355152 | T3 | 3/2011 |
| WO | 03/059529 | A1 | 7/2003 |
| WO | 2009/059859 | A2 | 5/2009 |
| WO | 2020/142125 | A2 | 7/2020 |

OTHER PUBLICATIONS

Chen, K., et al., "A five-component entropy-stabilized fluorite oxide", Journal of the European Ceramic Society, 38, (2018), pp. 4161-4164; https://doi.org/10.1016/j.jeurceramsoc.2018.04.063.

Cui, Y., et a., "Evolution of the residual stress in porous ceramic abradable coatings under thermal exposure", Surface & Coatings Technology, 394 (2020) 125915, pp. 1-9; https://doi.org/10.1016/j.surfcoat.2020.125915.

Dabrowa, J., et al., "Synthesis and microstructure of (Co,Cr,Fe,Mn,Ni)3O4 high entropy oxide characterized by spinel structure", Material Letters, 216 (2018) pp. 32-36; https://doi.org/10.1016/j.matlet.2017.12.148.

Djenadic, R., et al., "Multicomponent equiatomic rare earth oxides", Materials Research Letters, (2017), vol. 5, No. 2, pp. 102-109; https://dx.doi.org/10.1080/21663831.2016.1220433.

Foroushani, M.H., et al., "Porosity analysis and oxidation behavior of plasma sprayed YSZand YSZ/LaPO4 abradable thermal barrier coatings", Ceramics International 42 (2016) pp. 15868-15875; https://dx.doi.org/10.1016/j.ceramint.2016.07.057.

Gild, J., et al., "High-entropy fluorite oxides", Journal of the European Ceramic Society, 38 (2018) pp. 3578-3584; https://doi.org/10.1016/j.jeurceramsoc.2018.04.010.

Giri, A., et al., "On the minimum limit to thermal conductivity of multi-atom component crystalline solid solutions based on impurity mass scattering", Scripta Materials, 138 (2017) pp. 134-138; https://dx.doi.org/10.1016/j.scriptamat.2017.05.045.

Jiang, S., et al., "A new class of high-entropy perovskite oxides", Scripta Materialia, 142 (2018), pp. 116-120; https:// dx.doi.org/10.1016/j.scriptamat.2017.08.040.

Jonca, J., et al., "Oxidation behaviour of a CoNiCrAIY/h-BN based abradable coating", Corrosion Science, 153, (2019), pp. 170-177; https://doi.org/10.1016/j.corsci.2019.02.030.

Li, F., et al., "High-entropy pyrochlores with low thermal conductivity for thermal barrier coating materials", Journal of Advanced Ceramics, (2019), 8(4), pp. 576-582; https://doi.org/10.1007/s40145-019-0342-4.

Liu, Y.D., et al., "Investigation on high-speed rubbing behavior between abrasive coatings and Al/hBN abradable seal coatings", Wear, 456-457 (2020) 203389, pp. 1-12; https://doi.org/10.1016/j.wear.2020.203389.

Moballegh, A., et al., "Chemical homogeneity in entropy-stabilized complex metal oxides", Microsc. Microanal., 21 (Suppl 3), (2015), pp. 1349-1350; https://doi.org/10.1017/S1431927615007539.

Navrotsky, A., et al., "The thermodynamics of cation distributions in simple spinels", J. Inorg. Nucl. Chem., (1967), vol. 29, No. 11, pp. 2701-2714.

Rak, Z., et al., "Charge compensation and electrostatic transferability in three entropy-stabilized oxides: results from density functional theory calculations", J. Appl. Phys., 120 (2016) 095105; https://doi.org/10.1063/1.4962135.

Rak, Z., et al., "Evidence for Jahn-Teller compression in the (Mg,Co,Ni,Cu,Zn)O entropy-stabilized oxide: A DFT study", Materials Letters 217 (2018) pp. 300-303; https://doi.org/10.1016/j.matlet.2018.01.111.

Ren, K., et al., "Multicomponent high-entropy zirconates with comprehensive properties for advanced thermal barrier coating", Scripta Materialia, 178, (2020), pp. 382-386; https://doi.org/10.1016/j.scriptamat.2019.12.006.

Rost, C.M., et al., "Entropy-stabilized oxides", Nature Communications, (2015), 6:8485; DOI: 10.1038/ncomms9485.

Rost, C.M., "Entropically-stabilized oxides: Explorations of a novel class of multicomponent materials", Ph.D Thesis, North Carolina State Univ (2016), 227 pages.

Rost, C.M., et al., "Local structure of the MgxNixCoxCuxZnx (x=0.2) entropy-stabilized oxide: An EXAFS study", Journal of the American Ceramic Society, 100 (2017), pp. 2732-2738; DOI: 10.1111/jace. 14756.

Sarkar, A., et al., "Multicomponent equiatomic rare earth oxides with a narrow band gap and associated praseodymium multivalency", Dalton Transactions, (2017), 46, 12167; DOI: 10/1039/c7dt02077e.

Sarkar, A., et al., "Nanocrystalline multicomponent entropy stabilized transition metal oxide", Journal of the European Ceramic Society, 37, (2017), pp. 747-754; https://dx.doi.org/10.1016/j.jeurceramsoc.2016.09.018.

Sarkar, A., et al., "Rare earth and transition metal based entropy stabilized perovskite type oxides", Journal of the European Ceramic Society, 38, (2018), pp. 2318-2327; https://doi.org/10.1016/j.jeurceramsoc.2017.12.058.

Sarkar, A., et al., "High entropy oxides for reversible energy storage", Nature Communications, (2018) 9:3400; DOI: 10.1038/s41467-018-05774-5.

Soltani, R., et al., "Effect of APS process parameters on high-temperature wear behavior of nickel-graphite abradable seal coatings", Surface & Coatings Technology, 321, (2017), pp. 403-408; https://dx.doi.org/10.1016/j.surfcoat.2017.05.004.

Sun, X.M., et al., "Study on thermal shock behavior of YSZ abradable sealing coating prepared by mixed solution precursor plasma spraying", Surface & Coatings Technology, 397 (2020) 126045; https://doi.org/10.1016/j.surfcoat.2020.126045.

Sun, Y., et al. "Preparation and properties of CMAS resistant bixbyite structured high-entropy oxides RE2O3 (Re = Sm, Eu, Er, Lu, Y, and Yb): Promising environmental barrier coating materials for Al2O3f/Al2O3 composites", Journal of Advanced Ceramics, (2021), 10(3), pp. 596-613; https://doi.org/10.1007/s40145-021-0461-6.

Teng, Z., et al., "Synthesis and structures of high-entropy pyrochlore oxides", Journal of the European Ceramic Society, 40, (2020), pp. 1639-1643; https://doi.org/10.1016/j.jeurceramsoc.2019.12.008.

Wright, A.J., et al., "Size disorder as a descriptor for predicting reduced thermal conductivity in medium-and high-entropy pyrochlore oxides", Scripta Materialia, 181 (2020), pp. 76-81; https://doi.org/10.1016/j.scriptamat.2020.02.011.

International Search Report and Written Opinion of International Application No. PCT/US2022/020587, dated Oct. 17, 2022, 10 pages.

International Preliminary Report on Patentability of International Application No. PCT/US2022/020587 dated Sep. 12, 2023, 7 pages.

* cited by examiner

CHEMICALLY COMPLEX CERAMIC ABRADABLE SEALANT MATERIALS

CROSS-REFERENCE TO RELATED APPLICATION

This application claims the benefit and priority of U.S. Provisional Application No. 63/162,228 filed Mar. 17, 2021, the disclosure of which is expressly incorporated by reference herein in its entirety.

BACKGROUND OF THE INVENTION

1. Field of the Disclosure

The present disclosure relates to a thermal spray material feedstock having a high entropy oxide (HEO) and an abradable sealant coating to increase engine efficiency in high temperature regions of a turbine engine.

2. Background Information

Abradable seals are used in turbomachinery to reduce the clearance between rotating components (e.g., blades and labyrinth seal knife edges) and an engine casing. Reducing the clearance between rotating components and the engine casing improves the efficiency of a turbine engine, reduces fuel consumption, and reduces clearance safety margins by eliminating the possibility of catastrophic contact between the blade and engine casing. The abradable seal is produced by applying an abradable coating to the stationary part (engine casing), which rubs off upon contact with the tip of a rotating component (e.g., blade or knife edge) during operation. This process provides virtually no gap between the blade tip and the inner engine housing.

Conventional thermal spray powders produce abradable coatings for clearance control applications where the rotating component may contact the coating because of design intent or operational surges. The coatings are designed to minimize the wear on rotating components, while maximizing the gas-path efficiency by providing clearance control in sealed areas. Depending on the operating conditions required in an engine section of various engines, a conventional abradable seal can be an oxide ceramic or a metallic alloy based on aluminum, copper, cobalt, and/or nickel. In hot sections of engines, a conventional abradable seal material often includes a zirconia-based ceramic stabilized by rare earth oxides, such as yttria, ytterbia, and/or dysprosia. These coating concepts combine desired properties of high temperature ceramics with polymeric materials to generate porosity in the coating (e.g., Metco 2395 which is 8YSZ+4.5 wt % polyester+0.7 wt % hBN or M2460NS which is 8YSZ+4.0 wt % polyester). These coatings are suited for rub incursions against either bare untipped nickel alloy blades or tipped nickel alloy turbine blades.

To reduce blade wear, the mechanical properties of the ceramic abradable coating must be modified so that the ceramic is easily cut by the blades without causing significant blade wear. Conventional ceramic abradable coatings employ high porosity or filler phases, which lower the overall erosion resistance and hardness of the coating, to allow the abradable coatings to be cut.

SUMMARY

The present disclosure provides a thermal spray material feedstock that forms a coating with ultra-low erosion resistance (excellent abradability performance), high thermal stability, and chemical inertness. The use of high entropy oxides for ceramic based abradable sealant materials improves the cutting performance of ceramic based abradable coatings and eliminates wear damage on the following: (1) nickel alloy turbines blades (e.g., turbine sections of aero-engine, or land-based gas and steam turbine engines), and (2) tipped nickel alloy turbine blades (e.g., turbine sections of aero-engine or land-based gas and steam turbine engines). The use of ceramic abradable coatings made from high entropy oxides also improves thermal stability and sintering resistance resulting in higher service temperatures. Resistance to chemical attack by calcia magnesia aluminosilicates (CMAS) is also a desired property exhibited by HEOs. Another advantage of HEO-based ceramic abradable sealant materials is that, due to their brittle properties, the use of polyester as a fugitive phase is unnecessary to generate a high porosity level in the coating structure and achieve excellent abradability performance.

"Excellent abradability performance" is defined as resulting in low blade wear damage.

"Blade wear damage" is defined in one of the two following ways: (1) two body abrasive wear of the blade materials by ceramic material components in the designated 8 wt. % Yttria-stabilized Zirconia (YSZ) Polyester (Metco 2395 and Metco 2460NS), 48 wt. % Yttria-stabilized Zirconia (YSZ) Polyester (Metco 2461A), Dysprozia-stabilized Zirconia (DySZ) Polyester (Durabrade 2192), Ytterbia zirconate Polyester (Durabrade 2198) and Magnesia aluminate spinel (Metco 2245) based abradable coatings, and (2) severe wear damage arising from excessive heating of blade materials caused by severe friction incursion conditions in a turbine, and/or the abradable coating is thermal sprayed at excessively high bulk hardness conditions.

Examples of severe wear damage include blade materials that soften upon heating, extreme bulk plastic deformation, and fracture. Other examples of severe wear damage include oxidation of blade materials that arises from heating caused by friction. Further examples of severe wear damage include combustion of blade materials (mostly confined to titanium alloys). Even further examples of severe wear damage include cracking of blade materials due to extreme blade cutting forces that arises from inefficient cutting against abradable shrouds with higher than specified hardness.

Example embodiments of the present disclosure relate to a thermal spray material feedstock including chemically complex or "high entropy" oxides (HEOs) as abradable sealing coatings. HEOs allow for precise control of chemical, mechanical, and thermal properties for use in specific environments. In embodiments, HEOs of the present disclosure do not include any principle constituent oxide, such as zirconia, in a stabilized zirconia coating. In embodiments, the abradable sealing coating contains at least five principle oxide constituents at a high concentration of >5 mol %.

In example embodiments, the abradable sealing coating includes a sublattice with a mixture of five or more cations and at least one sublattice that comprises oxygen. The random ordering of five or more cations provides a material with a high configurational entropy ($S_{config}$). The inclusion of five or more elements also provides the ability to modify the phase composition to increase the abradability and chemical resistances in specific environments. Also, the inclusion of five or more elements leads to a high configurational entropy of individual phases, which results in an increased thermal stability. Thermal properties, such as thermal conductivity, can also be modified by including specific constituents to achieve superior performance.

HEOs have large lattice distortions and other defect concentrations, which results in low thermal conductivity. Due to their characteristically low thermal conductivity, HEOs have been investigated as thermal barrier coatings in turbine engines; however, the use of HEOs as abradable seal coatings has never been studied.

The present disclosure provides a new class of ceramic abradable seal compositions that exhibit an improved rub incursion behavior (abradability performance). Depending on the type of HEO that is employed, improved thermal properties, excellent sintering resistance, excellent phase stability, good thermal cycling performance, and resistance to chemical attack (e.g., by CMAS) can be obtained in the abradable seal coating of the present disclosure.

DETAILED DESCRIPTION

In an embodiment, an oxide ceramic is used as a sealant material or abradable seal material. In example embodiments, the overall combined atomic composition of the oxide ceramic is represented by general formula $M_xO_y$, where M is chosen from the group of at least five different oxide-forming metallic cations in an amount greater than 5 mol %. $M_xO_y$ is standard metallurgical shorthand. For example, the carbide $(Cr,Mo,W,Fe)_{23}C_6$ is commonly referred to as $M_{23}C_6$ and (TiNbTaZrHf)C is referred to as MC. Similarly, $M_xO_y$ may be used to describe the oxide $(Zr,Ce,Y,Yb,Gd,Dy)_xO_y$, where "M" is chosen from the group of at least five oxide-forming metals.

In an embodiment, the configurational entropy $S_{config}$ of the oxide ceramic is 1.5R per mole or greater, where R is the gas constant 8.314 $J \cdot K^{-1} \cdot mol^{-1}$. This value of $S_{config}$ is a commonly accepted definition of a high-entropy material. In embodiments, the metal cations "M" and oxygen anions "O" may be distributed on one or more crystal sublattice(s).

In embodiments of the present disclosure, the metals "M" may include non-toxic and non-radioactive oxide-forming metals, such as:

an alkaline-earth metal, including Be, Mg, Ca, Sr, and Ba;
a transition metal, including Sc, Y, Ti, Zr, Hf, V, Nb, Ta, Cr, Mo, W, Mn, Re, Fe, Ru, Co, Ni, Cu, and Zn; and
a lanthanide, including La, Ce, Pr, Nd, Pm, Sm, Eu, Gd, Tb, Dy, Ho, Er, Yb, and Lu.

For example, "M" is chosen from a group of at least 5 different oxide-forming metallic cations that includes at least one alkaline-earth metal, at least one transition metal, and at least one lanthanide. In another example, "M" is chosen from a group of at least 5 different oxide forming metallic cations from among an alkaline-earth metal, a transition metal, and a lanthanide.

In embodiments, the following metals may be used in HEO abradable seal coatings: (1) alkaline-earth metals, such as Mg and Ca; (2) transition metals, such as Y, Ti, Zr, Hf, V, Cr, Mo, and W; and (3) lanthanides, such as La, Ce, Pm, Sm, Eu, Gd, Tb, Dy, Er, and Yb.

In embodiments, the metal cations "M" and oxygen anions "O" may be distributed on one or more crystal sublattice(s). Accordingly, the oxide of the present disclosure may be physically manifested as one combined oxide structure of as a yet unknown crystal lattice $(Zr,Y,Yb,Gd,Dy)_xO_y$, or it may partition itself into two or more commonly known crystal lattices, e.g. $(Y,Yb,Gd,Dy)_2O_3$ and $(Zr,Ce)O_2$. In the latter case, this would imply two atoms from the group (Y,Yb,Gd,Dy) for every three oxygen atoms, and one atom from the group Zr and Ce for every two oxygen atoms, within the overall composition. It is expected that these oxide lattices are intimately mixed, so that it may be unable to detect separate phases in the HEO structure by scanning electron microscopy.

Two fundamental differences between embodiments of the present disclosure and Nicoll et al., Dieter et al., and Xie et al. references (listed below) include:

1. the high entropy ($S_{CONFIG}$ is greater than 1.5R) (this can be calculated for any composition using standard thermodynamic formulae, as described in, for example, Ref. 1), and
2. the greater number of "M" species.

A fundamental difference between embodiments of the present disclosure and the He et al. reference (listed below) is:

1. the application of the high entropy oxide as an abradable seal material.

While high-entropy oxides may have been used as thermal barrier coatings, the use of high-entropy oxides as an abradable seal is unknown. See, for example, the reference of Harrington (listed below as Ref. 16), which states that "eleven fluorite oxides with five principal cations (in addition to a four-principal-cation $(Hf_{0.25}Zr_{0.25}Ce_{0.25}Y_{0.25})O_{2-\delta}$ as a start point and baseline) were fabricated via high-energy ball milling, spark plasma sintering, and annealing in air."

In some aspects of the present disclosure, the high entropy oxide abradable coatings are additionally resistant to calcia magnesia alumina silica (CMAS). CMAS resistance is not an inherent feature of high entropy oxides, but rather is an independent property which is useful for abradable coatings. CMAS resistance is commonly measured by placing a CMAS material on top of an oxide coating to be tested, exposing the fabricated test coupon to elevated temperatures, and measuring the penetration of the CMAS into the oxide coating.

In example embodiments, the oxide is subjected to a test temperature of 1250° C. for 8 hours with a CMAS composition having a melting temperature of 1110-1125° C. for 8 hours. All CMAS penetration data presented in this disclosure were tested under these conditions, unless otherwise stated.

It has been determined that HEO coatings exhibit a higher resistance to molten silicate attack than 7YSZ. The addition of alkaline earth oxides ("AE") can further increase the resistance of high entropy oxides. The addition of AE has two effects: 1) increasing the melting temperature of the phases that form at the interface of the Thermal Barrier Coating ("TBC") and the molten silicate, and 2) providing the elements necessary for formation of the protective layer (e.g., Ca, Mg, and RE) in the coating, rather than only in the molten silicate. This dynamic modifies the protective layer phase formation kinetics and has been shown to form a preferred dense protective layer, rather than a needle-like morphology.

In practice, when molten silicates react with a coating containing transition metal oxides (e.g., $ZrO_2$) and Y and/or other rare earth dopants, the rare earth dopants forming the most stable high temperature phase (e.g., apatite) are preferentially leeched out of the coating.

High Y zirconia coatings, such as 48YSZ, can effectively form a moderate protective apatite in CMAS barriers. The desired protective layer is an apatite type layer having the following: AE2+yRE8+x(SiO4)6O2+3x/2+y. Since the layer contains both RE and AE elements that are in the CMAS, the inclusion of both rare earths and alkaline earth in varying amounts in the coating can manipulate the apatite phase growth kinetics via changing concentration gradients. When the AE and RE concentrations in the coating are both high, Si diffuses into the coating from the molten CMAS to form the apatite. When AE is not included in the coating, the RE elements diffuse out of the coating to form apatite with silicates which were contained in the CMAS. The apatite that forms from Si diffusing into the coating is more protective.

This effect is particularly important in high entropy or complex concentrated oxides because it is far more pronounced when the alkaline earth metals are in solution with the transition metal oxides (in this case $ZrO_2$, $HfO_2$, $TiO_2$, $Y_2O_3$, $Nb_2O_5$, $V_2O_5$, $Ta_2O_5$, $Cr_2O_3$, $MoO_3$, $WO_3$) and the rare earth oxides of the lanthanide series ($La_2O_3$, $CeO_2$, $Nd_2O_3$, $Sm_2O_3$, $Eu_2O_3$, $Gd_2O_3$, $Tb_2O_3$, $Dy_2O_3$, $Ho_2O_3$, $Er_2O_3$, $Yb_2O_3$, and $Lu_2O_3$) and any mixtures thereof, rather than in a separate phase. The basic principle is to inhibit the diffusion of AE and RE elements out of the coating and into the CMAS, forcing Si to diffuse into the coating to form the apatite phase. A highly disordered single phase solid solution containing the RE and AE elements will further slow their diffusion out of the material.

Embodiments of the present disclosure include a mixture of oxides containing transition metals, rare earth oxides in the lanthanide series, and alkaline earth metals. In embodiments, the alkaline earth oxides modify the formation kinetics of an apatite layer that forms at the interface of the protective coating and the molten silicate. The kinetics result in a fully dense and continuous layer between the molten silicate and the solid coating. In a conventional coating, such as 7YSZ, the apatite layer is not protective and leeching of the coating material is rapid and uninhibited.

In embodiments of the present disclosure, the protective layer that forms at the interface is a complex oxide that contains alkaline earth elements (i.e., Be, Mg, Ca, Sr, and Ba), yttrium or rare earth elements (i.e., Y, La, Ce, Pr, Nd, Pm, Sm, Eu, Gd, Tb, Dy, Ho, Er, Tm, Yb, and Lu) and Si. When the source of AE and/or Si is only within the molten silicate or CMAS, the morphology of the layer is needle-like and minimally protective. When AE, which is necessary for the formation of the protective interface phase, is found in the coating, the coating morphology is dense and continuous at the interface. This provides a protective effect, which inhibits the further leeching of RE and AE elements from the coating.

Example embodiments of the present disclosure include coatings that contain at least four group A compounds and one group B compound. Group A compounds include $ZrO_2$, $HfO_2$, $TiO_2$, $Y_2O_3$, $Nb_2O_5$, $V_2O_5$, $Ta_2O_5$, $Cr_2O_3$, $MoO_3$, $WO_3$, $La_2O_3$, $CeO_2$, $Nd_2O_3$, $Sm_2O_3$, $Eu_2O_3$, $Gd_2O_3$, $Tb_2O_3$, $Dy_2O_3$, $Ho_2O_3$, $Er_2O_3$, $Yb_2O_3$, and $Lu_2O_3$. Group B compounds include MgO, CaO, $CaCO_3$, SrO, $SrCO_3$, BaO, and $BaCO_3$. In embodiments, a coating composition is provided where the protective layer is not apatite type; however, it is still controlled by the inclusion of AE elements and RE elements in complex solution in the coating.

In some embodiments, it is desirable to reduce the content of costly oxides typically formed from rare earth metals for the purposes of minimizing the raw material cost. In embodiments, the rare earth metals include Yttrium, Gadolinium, Neodymium, Dyprosium, Hafnium, nioubium, and tantalum. In one embodiment, it is desirable to minimize the costly oxide content, including at least one of Hf-oxide, Ta-oxide, Dy-oxide, Nb-oxide, Nd-oxide, Gd oxide, and Y oxide to below 55 wt. %. In embodiments, the costly oxide includes any stoichiometry between the metal species and oxide. In a preferred embodiment, the costly oxide content of the HEO is below 50 wt. %. In a more preferred embodiment, the costly oxide content of the HEO is below 45 wt. %. For comparison, Gadolinium Zirconate, mentioned in this disclosure as a known CMAS resistant oxide, has 59-60 wt. % Gadolinium, thus equaling a costly oxide content of 59-60 wt %.

In some embodiments, the HEO chemistry includes:

5-14 wt % of alkaline earth metal oxides, such as $CaCo_3$, CaO, or MgO;

35-70 wt % of rare earth metal oxides, such as $Yb_2O_3$, $Gd_2O$, or $Sm_2O_3$;

13-57 wt % of $ZrO_2$; and 6-20 wt % of $Y_2O_3$.

In some embodiments $Al_2O_3$ can be added up to 3 wt %. In other embodiments, $La_2O_3$ or other sources of La are specifically limited to below 2 wt %. In some embodiments, any source of La is limited to below 0.5 wt %.

In embodiments, the HEO chemistry, (representing the HEO-2 chemistry) includes:

11-17 wt % of alkaline earth metal oxides, such as $CaCO_3$;

55-83 wt % of rare earth metal oxides, such as $Yb_2O_3$, $Gd_2O_3$, or $Y_2O_3$;

22-33 wt % $Yb_2O_3$;

20-31 wt % $Gd_2O_3$;

12-19 wt % $Y_2O_3$; and 13-21 wt % $ZrO_2$.

In embodiments, the amount of alkaline earth metal oxides is 12.5-15.5 wt %. In embodiments, the amount of rare earth metal oxides is 61-76 wt %. In other embodiments, the amount of rare earth metal oxides is 22-33 wt %. In embodiments, the amount of $Y_2O_3$ is 14-18 wt %. In embodiments, the amount of $ZrO_2$ is 15-19 wt %.

In embodiments, the HEO chemistry, (representing the HEO-8 chemistry) includes:

5-9 wt % of alkaline earth metal oxides, such as MgO;

41-63 wt % of rare earth metal oxides, such as 1-2 wt % of $La_2O_3$ and 24-38 wt % $Gd_2O_3$ Preferably, the costly oxide content of $Y_2O_3$ and $Gd_2O_3$ is below 55 wt. %

15-24 wt % $Y_2O_3$; and a balance of $ZrO_2$.

In embodiments, the amount of alkaline earth metal oxides is 6-8 wt %. In embodiments, the amount of rare earth metal oxides is 46-58 wt %. In embodiments, the amount of rare earth metal oxides is 22-33 wt %. In embodiments, the amount of $Y_2O_3$ is 14-18 wt %. In embodiments, the amount of $ZrO_2$ is 15-19 wt %. In embodiments, the amount of $Y_2O_3$ is 17-22 wt %.

In embodiments, the HEO chemistry, (representing the HEO-9 chemistry) includes:

4-7 wt % of alkaline earth metal oxides, such as 2-4 wt % CaO and 1-3 wt % MgO;

28-43 wt % of rare earth metal oxides, such as 8-13 wt % $Yb_2O_3$, 7-12 wt % $Gd_2O_3$, 7-12 wt % $Sm_2O_3$;

4-8 wt % $Y_2O_3$; and a balance of $ZrO_2$.

Preferably, the costly oxide content of $Y_2O_3$, $Yb_2O_3$, and $Gd_2O_3$ is below 40 wt. %

In embodiments, the amount of rare earth metal oxides is 32-40 wt %. In embodiments, the amount of $Y_2O_3$ is 5-7 wt %.

In embodiments, the HEO chemistry, (representing the HEO-10 chemistry) includes:

8-14 wt % of alkaline earth metal oxides, such as 5-8 wt % CaO and 3-6 wt % MgO;

60-91 wt % of rare earth metal oxides, such as 18-27 wt % $Yb_2O_3$, 16-25 wt % $Gd_2O_3$, and 15-24 wt % $Sm_2O_3$;

4-16 wt % $Y_2O_3$; and a balance of $ZrO_2$.

In embodiments, the amount of $Y_2O_3$ is 10-16 wt %. In other embodiments, the amount of $Y_2O_3$ is 4-8 wt %.

In some embodiments, the HEO has a high CMAS resistance as demonstrated by a low penetration depth when subject to the CMAS testing conditions discussed above. In some embodiments, the CMAS penetration depth is less than 100 μm. In other embodiments, the CMAS penetration depth is less than 85 μm. In still other embodiments, the CMAS penetration depth is less than 70 μm.

As mentioned previously, CMAS resistance is not an inherent attribute to HEO materials, and it was experimentally determined by the present inventors that several experimental HEOs had a high CMAS penetration depth. For example, a conventional TBC coating of 7YSZ was determined to have a CMAS penetration depth of >400 μm. As another example, a TBC coating of GZO, which is another widely used TBC known in part for improved CMAS resistance over 7 YSZ was determined to have a CMAS penetration of ~150 μm.

In embodiments, the oxide of the present disclosure has a high CMAS resistance as demonstrated by the formation of an apatite phase. It has been determined by the present inventors that an elevated amount of alkaline earth metals increases the CMAS resistance. However, it has also been determined that excessively high alkaline earth metal content can shift the reaction product to a phase other than apatite. For example, some high Mg content experimental compositions have been generated which form olivine. Thus, there is a need to balance the alkaline earth metal content while not over doping the oxide as to shift the reaction product to a phase other than apatite.

In some embodiments, the oxide of the present disclosure includes one component of an abradable coating. In other embodiments, the abradable coating includes one or more of the following: (1) porosity formers, such as polyester, polymers, polyimides, and/or PMMA; (2) solid lubricants, such as graphite, hBN, or Calcium Flouride; and (3) other filler phases, such as Talc or Clays, or metal alloys.

Further, at least because the invention is disclosed herein in a manner that enables one to make and use it, by virtue of the disclosure of particular exemplary embodiments, such as for simplicity or efficiency, for example, the invention can be practiced in the absence of any additional element or additional structure that is not specifically disclosed herein.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

PRIOR ART REFERENCES

All of the following references are hereby incorporated by reference:

US Patents

1. U.S. Pat. No. 4,421,799 to E. R. Novinski
2. U.S. Pat. No. 4,578,114 to S. Rangaswamy
3. U.S. Pat. No. 5,059,095 to B. A. Kushner
4. U.S. Pat. No. 5,997,248 to F. Ghasripoor
5. U.S. Pat. No. 6,812,176 to D. Zhu
6. U.S. Pat. No. 6,887,528 to Y. Lau
7. U.S. Pat. No. 7,001,859 to D. Zhu
8. U.S. Pat. No. 7,186,466 to D. Zhu
9. U.S. Pat. No. 8,187,717 to L. Xie
10. U.S. Pat. No. 9,581,041 to R. J. Sinatra
11. U.S. Pat. No. 9,975,812 to J. C. Doesburg US Patent Publications 12. 2005/0196271A1 Sep. 8, 2005 to WILSON
13. 2009/0060747A1 Mar. 5, 2009 to STROCK
14. 2011/0164963A1 Jul. 7, 2011 to TAYLOR
15. 2018/0022928A1 Jan. 25, 2018 to BLUSH
16. 2018/0022929A1 Jan. 25, 2018 to BLUSH
17. 2018/0298776A1 Oct. 18, 2018 to STROCK
18. 2018/0128952A1 May 10, 2018 to YEH
19. 2020/0003125A1 Jan. 2, 2020 to AMINI
20. 2020/0141260A1 May 7, 2020 to SEYMOUR AU Patent Publications 21. 2014/221259A1 Oct. 2, 2014 to LEACH CA Patents 22. CA Patent 2431310 to D. Mitchell
23. CA Patent 2488949 to W. Scott
24. CA Patent 2549600 to N. Andrew
25. CA Patent 2585992 to S. Dieter
26. CA Patent 2686332 to M. Cybulsky
27. CA Patent 2880147 to M. Podgorski
28. CA Patent 2914289 to R. Larry
29. CA Patent 3051995 to A. Bolcavage EP Patents 30. EP Patent to 0455996 to K. Burton
31. EP Patent to 1371815 to F. Braillard
32. EP Patent to 1548144 to W. Scott
33. EP Patent to 1500790 to F. Gross
34. EP Patent to 2683844 to K. Lee
35. EP Patent to 3141704 to Y. Kojima
36. EP Patent to 3369487 to T. Kurimura
37. EP Patent to 3597860 to K. Seymour
38. EP Patent to 3597871 to R. W. Jackson
39. EP Patent to 3623355 to W. R. Schmidt ES Patents 40. ES Patent to 2355152 to W. Scott WO Patent Publications 41. 2003/059529A1 Jul. 24, 2003 to WILSON
42. 2009/059859A2 May 14, 2009 to D. B. ALLEN
43. 2020/142125A2 Jul. 9, 2020 to HE Research Publications MO (HEOs Having the Rock Salt "NaCl" Crystal Lattice Structure)

1. C. M. Rost, *Ph.D thesis, North Carolina State Univ* (2016), "Entropically-stabilized oxides: Explorations of a novel class of multicomponent materials".
2. C. M. Rost, E. Sachet, T. Borman, A. Moballegh, E. Dickey, D. Hou, J. Jones, S. Curtarolo, J. P. Maria, *Nature Communications: Sep.* 25, 2015, "Entropy-stabilized oxides".
3. Moballegh, C. M. Rost, Jon-Paul Maria, E C. Dickey, *Microsc. Microanal.,* 21(2015), pp. 1349-1350: "Chemical homogeneity in entropy-stabilized complex metal oxides".
4. Z. Rak, J-P, Maria, D. W. Brenner, *Mater Lett:* 217 (2018) pp. 300-303: "Evidence for Jahn-Teller compression in the (Mg,Co,Ni,Cu,Zn)O entropy."
5. C. M. Rost, Z. Rak, D. W. Brenner J.-P. Maria, *J. Am Ceramic Society,* 100(2017), pp. 2732-2738, "Local structure of the $Mg_xNi_xCo_xCu_xZn_x$ (x=0.2) entropy-stabilized oxide: An EXAFS study".
6. Z. Rak, C. M. Rost, M. Lim, P. Sarker, C. Toher, S. Curtarolo, J. P. Maria, D. W. Brenner, *J. App. I Phys.,* 120 (2016) pp. 95-105, "Charge compensation and electrostatic transferability in three entropy-stabilized oxides: results from density functional theory calculations"
7. G. Anand, A. P. Wynn, C. M. Handley, C. L. Freeman, *Acta Mater.,* 146(2018) pp. 119-125, "Phase stability and distortion in high entropy oxides"
8. Sarkar, R. Djenadic, N. J. Usharani, K. P. Sanghvi, *J. Euro Ceram Soc,* 37(2017) pp. 747-754, "Nanocrystalline multicomponent entropy stabilized transition metal oxide".
9. D. Berardan, S. Franger, D. Dragoe, A. K. Meena and N. Dragoe, Phys. *Status Solidi RRL* 10, 4(2016), pp. 328-333, "Colossal dielectric constant in high entropy oxides"
10. D. Berardan, S. Franger, A. K. Meena and N. Dragoe, *J. Mater. Chem. A,* 24(2016), pp. 9536-9541, "Room temperature Lithium superionic conductivity in high entropy oxides"
11. D. Berardan, A. K. Meena, S. Franger, C. Herrero and N. Dragoe, *J. Alloys and Compounds,* 704(2017) pp. 693-700, "Controlled Jahn-Teller distortion in (MgCoNiCuZn)O-based high entropy oxides"
12. Sarkar, L. Velasco, D. Wang, Q. Wang, G. Talasila, L. de Biasi, C. Kubel, T. Brezesinski, S. Bhattacharya, H. Hahn, B. Breitung, *Nature Communications:* 08-24-2018, "High entropy oxides for reversible energy storage"

$MO_2$ (HEOs Having the Fluorite "$CaF_2$" Crystal Lattice Structure)

13. R. Djenadic, A. Sarkar, O. Clemens, C. Loho, M. Botros, V. Chakravadhanula, C. Kubel, S. Bhattacharya, A. Gandhi, H. Hahn, *Mater. Res. Lett.* 5(2017), pp. 102-109, "Multicomponent equiatomic rare earth oxides"
14. K. Chen, X. Pei, L. Tang, H. Cheng, Z. Li, C. Li, X. Zhang, L. An, *J. Euro Ceram Soc,* 38(2018) pp. 4161-64, "A five-component entropy-stabilized fluorite oxide".
15. A. Sarkar, C. Loho, L., Velasco, T. Thomas; S. Bhattacharya, H. Hahn, R. Djenadic, *Dalton Transactions* 36(2017), pp. 12167-176, "Multicomponent equiatomic rare earth oxides"
16. Gild, J., Samiee, M., Braun, J. L., Harrington, T., Vega, H., Hopkins, P. E., Vecchio, K., and Luo, J., *J Euro Ceram Soc,* 38(2018) pp. 3578-3584, "High-entropy fluorite oxides"

$ABO_3$ (HEOs Having the Perovskite Crystal Lattice Structure)

17. S. Jiang, T. Hu, J. Gild, N. Zhou, J. Nie, M. Qin, T. Harrington, K. Vecchio, J. Luo, *Scripta Mater,* 142(2018), pp. 116-120, "A new class of high-entropy perovskite oxides"
18. A. Sarkar, R. Djenadic, D. Wang, C. Hein, R. Kautenburger, O. Clemens, H. Hahn, *J Euro Ceram Soc,* 38(2018) pp. 2318-2327, "Rare earth and transition metal based entropy stabilized perovskite type oxides".

$M_3O_4$ (HEOs Having the Spinel Crystal Lattice Structure)

19. J. Dabrowa, M. Stygar, A. Mikula, A. Knapik, K. Mroczka, W. Tejchman, M. Danielewski and M. Martin, *Mater. Lett,* 216(2018) pp. 32-36, "Synthesis and microstructure of $(Co,Cr,Fe,Mn,Ni)_3O_4$ high entropy oxide characterized by spinel structure".
20. A. Navrotsky and O. J. Klepp. a, *J. Inorg. Nucl. Chem.*, vol 29, no. 11, pp. 2701-2714, 1967, "The thermodynamics of cation distributions in simple spinels".

$A_2B_2O_6$ (HEOs Having the Pyrochlore Crystal Lattice Structure)

21. Li, F., Zhou, L., Liu, J. X., Liang, Y., & Zhang, G. J., *Journal of Advanced Ceramics,* 4(2019), pp. 576-582, "High-entropy pyrochlores with low thermal conductivity for thermal barrier coating materials".
22. Wright, A. J., Wang, Q., Ko, S. T., Chung, K. M., Chen, R., & Luo, J., *Scripta Materialia,* 181(2020), pp. 76-81, "Size disorder as a descriptor for predicting reduced thermal conductivity in medium- and high-entropy pyrochlore oxides".
23. Teng, Z., Zhu, L., Tan, Y., Zeng, S., Xia, Y., Wang, Y., & Zhang, H., *J Euro Ceram Soc,* 40(2020), pp. 1639-1643, "Synthesis and structures of high-entropy pyrochlore oxides".
24. Ren, K., Wang, Q., Shao, G., Zhao, X., & Wang, Y, *Scripta Materialia,* 178(2020) pp. 382-386, "Multicomponent high-entropy zirconates with comprehensive properties for advanced thermal barrier coating".

GENERAL REFERENCES

25. A. Giri, J. Braun, C. M. Rost, P. E Hopkins, *Scripta Mater.,* 138(2017) 134-138, "On the minimum limit to thermal conductivity of multi-atom component crystalline solid solutions based on impurity mass scattering"

Ceramic Abradables

26. J. Jonca, B. Malard, J. Soulie, T. Sanviemvongsak, S. Selezneff, and A. V. Put, Corros. Sci., 153 (2019) 170-177, "Oxidation behaviour of a CoNiCrAlY/h-BN based abradable coating"
27. Y. D. Liu, J. P. Jhang, Z. L. Pei, J. H. Liu, W. H. Li, J. Gong, and C. Sun, Wear, 456-457 (2020) 203389, "Investigation on high-speed rubbing behavior between abrasive coatings and Al/hBN abradable seal coatings"
28. R, Soltani, M. Heydarzadeh-Sohi, M. Ansari, F. Afsari, and Z. Valefi, Surf. Coat. Technol., 321 (2017) 403-408, "Effect of APS process parameters on high-temperature wear behavior of nickel-graphite abradable seal coatings"
29. Y. Cui, M. Guo, C. Wang, Z. Tang, L. Cheng, Surf. Coat. Technol., 394 (2020) 125915, "Evolution of the residual stress in porous ceramic abradable coatings under thermal exposure"
30. X. M. Sun, L. Z. Du, H. Lan, H. F. Zhang, R. Y. Liu, Z. G. Wang, S. G. Fang, C. B. Huang, Z. A. Liu, and W. G. Zhang, Surf. Coat. Technol., 397 (2020) 126045, "Study on thermal shock behavior of YSZ abradable sealing coating prepared by mixed solution precursor plasma spraying"
31. M. H. Foroushani, M. Shamanian, M. Salehi, and F. Davar, Ceram. Int., 42 (2016) 15868-15875, "Porosity analysis and oxidation behavior of plasma sprayed YSZand YSZ/LaPO4 abradable thermal barrier coatings"

What is claimed:

1. A thermal spray material feedstock, comprising:

a high entropy oxide (HEO) having calcia magnesia alumina silicate (CMAS) resistance, wherein when the oxide is reacted at 1250° C. for 8 hours with a CMAS having a low melting temperature of 1110° C. to 1125° C., the oxide exhibits a CMAS penetration depth of 100 μm or less.

2. The thermal spray material feedstock of claim 1, wherein the oxide comprises:

5-14 wt % of an alkaline earth metal oxide;

35-70 wt % of a rare earth metal oxide;

6-20 wt % of $Y_2O_3$; and a balance of $ZrO_2$.

3. The thermal spray material feedstock of claim 1, wherein the oxide comprises:

5-9 wt % of an alkaline earth metal oxide;

41-63 wt % of a rare earth metal oxide;

15-24 wt % of $Y_2O_3$; and a balance of $ZrO_2$.

4. The thermal spray material feedstock of claim 3, wherein the alkaline earth metal oxide is MgO.

5. The thermal spray material feedstock of claim 3, wherein the rare earth metal oxide comprises at least one of 1-2 wt % $La_2O_3$ and 24-38 wt % $Gd_2O_3$.

6. The thermal spray material feedstock of claim 3, comprising a total costly oxide content comprising at least one of $Y_2O_3$ and $Gd_2O_3$ that is 55 wt. % or lower.

7. The thermal spray material feedstock of claim 2, wherein the alkaline earth metal oxide is at least one of $CaCO_3$, CaO, or MgO.

8. The thermal spray material feedstock of claim 2, wherein the rare earth metal oxide is at least one of $Yb_2O_3$, $Gd_2O$, or $Sm_2O_3$.

9. The thermal spray material feedstock of claim 1, comprising lower than 2 wt % of $La_2O_3$ or other sources of La.

10. The thermal spray material feedstock of claim 1, comprising a total costly oxide content comprising at least one of Hf-oxide, Ta-oxide, Dy-oxide, Nb-oxide, Nd-oxide, Gd-oxide, and Y-oxide that is 55 wt. % or lower.

11. A method for manufacturing an abradable sealing coating comprising:

plasma spraying the thermal spray material feedstock of claim 1 onto a turbine blade or a part of a jet engine, wherein the thermal spray material feedstock comprises an oxide that interfaces with the turbine blade or the part of the jet engine.

12. An abradable sealant coating comprising the HEO of claim 1.

13. The abradable sealant coating of claim 12, wherein the HEO has a high configurational entropy that is greater than 1.5R.

14. The abradable sealant coating of claim 12, further comprising a thermal barrier coating base coat.

15. The abradable sealant coating of claim 14, wherein all oxides form a single phase solid solution.

16. The abradable sealant coating of claim 14, wherein multiple oxide phases are present.

17. The abradable sealant coating of claim 14, wherein the abradable sealant coating has a porosity of about 30-70% by cross-sectional area.

18. The abradable sealant coating of claim 14, wherein the abradable sealant coating comprises at least one fugitive phase.

19. The abradable sealant coating of claim 18, wherein the at least one fugitive phase comprises polyester, talc, and boron nitride.

20. The abradable sealant coating of claim 12, wherein the HEO is represented by general formula $M_xO_y$, wherein M is chosen from a group comprising at least 5 different oxide-forming metallic cations.

21. The abradable sealant coating of claim 12, wherein the HEO is represented by general formula $M_xO_y$, wherein M is chosen from at least one member of Group II in the periodic table.

22. The abradable sealant coating of claim 12, wherein the HEO is represented by general formula $M_xO_y$, wherein M is chosen from at least one lanthanide in the periodic table.

23. The abradable sealant coating of claim 12, wherein the HEO is represented by general formula $M_xO_y$, wherein M is chosen from at least one transition metal.

24. The abradable sealant coating of claim 12 comprising 5 or more different oxide-forming metallic cations in an amount greater than 5 mol %.

25. A turbine blade comprising the abradable sealant coating of claim 12.

26. A part of a jet engine comprising the abradable sealant coating of claim 12.

27. A high entropy oxide powder comprising:

5-14 wt % of at least one alkaline earth metal oxide comprising $CaCO_3$, CaO, or MgO;

35-70 wt % of at least one rare earth metal oxide comprising $Yb_2O_3$, $Gd_2O$, or $Sm_2O_3$;

6-20 wt % $Y_2O_3$; and a balance of $ZrO_2$;

wherein the high entropy oxide powder has a high configurational entropy that is greater than 1.5R.

28. A thermal spray material feedstock, comprising:

an oxide having calcia magnesia alumina silicate (CMAS) resistance, wherein when the oxide is reacted at 1250° C. for 8 hours with a CMAS having a low melting temperature of 1110° C. to 1125° C., the oxide exhibits a CMAS penetration depth of 100 μm or less; and wherein the oxide is a high entropy oxide powder having a high configurational entropy that is greater than 1.5R.

29. The thermal spray material feedstock of claim 28, wherein the high entropy oxide powder comprises, 5-14 wt % of at least one alkaline earth metal oxide comprising $CaCO_3$, CaO, or MgO;

35-70 wt % of at least one rare earth metal oxide comprising $Yb_2O_3$, $Gd_2O$, or $Sm_2O_3$;

6-20 wt % $Y_2O_3$; and a balance of $ZrO_2$.

* * * * *